US007112026B1

(12) United States Patent
Foster

(10) Patent No.: US 7,112,026 B1
(45) Date of Patent: Sep. 26, 2006

(54) CABINET LIFTING DEVICE

(76) Inventor: Roy E. Foster, 710 Westwood Dr., Catlin, IL (US) 61817

( * ) Notice: Subject to any disclaimer, the term of this patent is extended or adjusted under 35 U.S.C. 154(b) by 117 days.

(21) Appl. No.: 10/755,102

(22) Filed: Jan. 12, 2004

(51) Int. Cl.
*E04G 25/08* (2006.01)

(52) U.S. Cl. ..... 414/10; 248/354.1; 269/289 R; 269/904

(58) Field of Classification Search ..... 414/10–12; 187/244, 252, 900; 269/904; 312/249.1; 248/354.7
See application file for complete search history.

(56) References Cited

U.S. PATENT DOCUMENTS

| | | | | | |
|---|---|---|---|---|---|
| 1,639,962 | A * | 8/1927 | Pfiffner | 414/10 |
| 1,918,745 | A * | 7/1933 | Forsythe | 248/354.7 |
| 2,148,396 | A * | 2/1939 | Baker | 248/354.1 |
| 2,586,227 | A * | 2/1952 | Lee | 414/10 |
| 2,672,319 | A * | 3/1954 | Nelson | 414/10 |
| 2,777,660 | A * | 1/1957 | Albrecht | 248/354.5 |
| 2,814,099 | A | 11/1957 | Knittel | |
| 4,508,316 | A * | 4/1985 | Millard | 254/4 R |
| 4,600,348 | A * | 7/1986 | Pettit | 414/11 |
| 4,715,760 | A * | 12/1987 | Browning | 414/10 |
| 4,955,592 | A * | 9/1990 | Brennan, Sr. | 269/68 |
| D338,310 | S | 8/1993 | Clarke | |
| 5,275,390 | A * | 1/1994 | Brennan | 269/68 |
| 5,609,332 | A * | 3/1997 | Hassell | 269/16 |
| 5,645,272 | A * | 7/1997 | Brennan, Sr. | 269/68 |
| 6,238,159 | B1 * | 5/2001 | Pappas | 414/10 |
| 6,322,062 | B1 * | 11/2001 | Conn et al. | 269/20 |
| 6,505,803 | B1 * | 1/2003 | Hernandez | 248/354.5 |
| 6,581,921 | B1 * | 6/2003 | Griggs | 269/37 |
| 6,607,341 | B1 * | 8/2003 | Wade | 414/10 |
| 6,612,533 | B1 * | 9/2003 | Biles et al. | 248/354.1 |
| 6,773,218 | B1 * | 8/2004 | Mingoes | 414/10 |
| 6,942,198 | B1 * | 9/2005 | Huang | 254/387 |

* cited by examiner

*Primary Examiner*—Eileen D. Lillis
*Assistant Examiner*—Charles N. Greenhut

(57) ABSTRACT

A device for lifting and supporting a cabinet during installation thereof and including elongated support legs and elongated dowels connected to the support legs for preventing the movement of the support legs and for maintaining the device at a substantially stable positioned during operating conditions. Side panels are secured to the upper end of the support legs for defining a cavity therebetween, and a moveable section is disposed substantially medially of the side panels. There is a pulley mechanism for selectively lifting the movable section in a substantially vertical direction between raised and lowered positions that is disposed within the cavity and is anchored to the moveable section and the side panels.

5 Claims, 5 Drawing Sheets

CABINET LIFTING DEVICE

CROSS REFERENCE TO RELATED APPLICATIONS

Not Applicable.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION

1. Technical Field

This invention relates to a lifting device and, more particularly, to a cabinet lifting device for assisting an operator to maintain a cabinet steady during an installation process.

2. Prior Art

The installation of cabinets and the like within kitchens is difficult for one person to accomplish in view of the size of the cabinets and the confines of the kitchen enclosure. Normally, when installing an item such as a cabinet or ceiling frame, it is necessary for a helper to lift the cabinet in place against a wall or ceiling while the item is secured to the wall or ceiling by the installer. The use of a helper increases the labor cost of such installation. However, there are several drawbacks to using another person as helper.

For example, it is very difficult for a helper to hold a cabinet steady in the selected or proper position. In addition, the helper is usually directly in the installer's way. If the installer does not have a helper, then the installer must use props of some type under the cabinet or must simply be strong enough to hold the cabinet up with one hand while fastening it with the other. These approaches are usually clumsy, unsatisfactory and dangerous. In addition, lifting cabinets can cause back injuries and other medical problems.

It would be highly desirable to provide an apparatus that can be safely operated by one person to lift and hold a cabinet in place while that person secures the cabinet to the wall or ceiling. A further problem associated with positioning such cabinets is the requirement to level and shim the cabinets prior to final installation. The use of conventional vertical lifting devices, per se, does not readily allow such leveling and horizontal positioning of the cabinets.

Accordingly, a need remains for a cabinet lifting device to overcome the above-noted shortcomings.

BRIEF SUMMARY OF THE INVENTION

In view of the foregoing background, it is therefore an object of the present invention to provide a hydraulically operable device for lifting cabinets. These and other objects, features, and advantages of the invention are provided by a device for lifting and supporting a cabinet during installation thereof wherein the device includes a plurality of elongated support legs having lower end portions and respective upper end portions disposed substantially vertically thereabove. The device may further include a plurality of castor wheels attached to select ones of the plurality of support legs for advantageously allowing the device to be readily transported between remote locations.

The device further includes a plurality of elongated dowels connected to the plurality of support legs and extending substantially transversely therebetween respectively. The plurality of dowels advantageously prevents movement of the plurality of support legs and maintains the device at a substantially stable positioned during operating conditions. The present invention further includes a plurality of side panels secured to the upper end portions of the plurality of support legs for defining a cavity therebetween.

The device further includes a moveable section that has a longitudinal axis and is disposed substantially medially of the plurality of side panels. A pulley mechanism selectively lifts the movable section in a substantially vertical direction between raised and lowered positions. The movable section preferably includes a plurality of spacers connected between the plurality of first support members for assisting to maintain same at substantially stable positions. The pulley mechanism is partially disposed within the cavity and is anchored to the moveable section and the plurality of side panels.

Such a pulley mechanism preferably includes a plurality of spaced cross-braces extending substantially parallel to the axis and that has opposed end portions connected to select ones of the plurality of side panels. The pulley mechanism further has a plurality of elongated first support members, that may be oriented in a substantially vertical position, and that has lower and upper end portions respectively.

A support bracket may be connected to the upper end portions of the plurality of first support members and to the movable platform respectively. The present invention further includes a plurality of second support members connected medially of the plurality of cross-braces and adjacent the plurality of first support members. Such a plurality of second support members preferably define a path through which the plurality of first support members are movable.

An elongated flexible rope has opposed end portions secured to the shaft and one side panel respectively and a plurality of sheaves are connected to the plurality of first and second support members respectively. The plurality of second support members may include an upper end portion that has a notch formed therein respectively for advantageously supporting one of the plurality of sheaves therein. The plurality of sheaves preferably have a grooved rim for receiving the rope therealong and for advantageously changing a direction and a point of application of a pulling force and in a predetermined combination to increase the applied force for lifting a cabinet positioned onto the movable platform.

The present invention may also include a cranking mechanism for operably winding the rope in a predetermined direction. Such a cranking mechanism includes an elongated shaft that has opposed end portions secured to the plurality of second support members and preferably extending outwardly from one the plurality of side panels respectively. A gear that has a serrated outer surface is connected to the shaft and a crank handle is connected to the shaft for causing the gear to rotate in a predetermined direction as the handle is radially moved about the shaft.

The cranking mechanism further includes a pawl that has a first end portion pivotally connected to the one side panel and further has a second end portion selectively engageable with the gear for advantageously permitting the gear and the shaft to rotate in only one direction, thereby preventing the platform from unexpectedly moving downwardly after a cabinet is placed thereon.

BRIEF DESCRIPTION OF THE SEVERAL VIEWS OF THE DRAWING

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

DETAILED DESCRIPTION OF THE INVENTION

Figure 1:
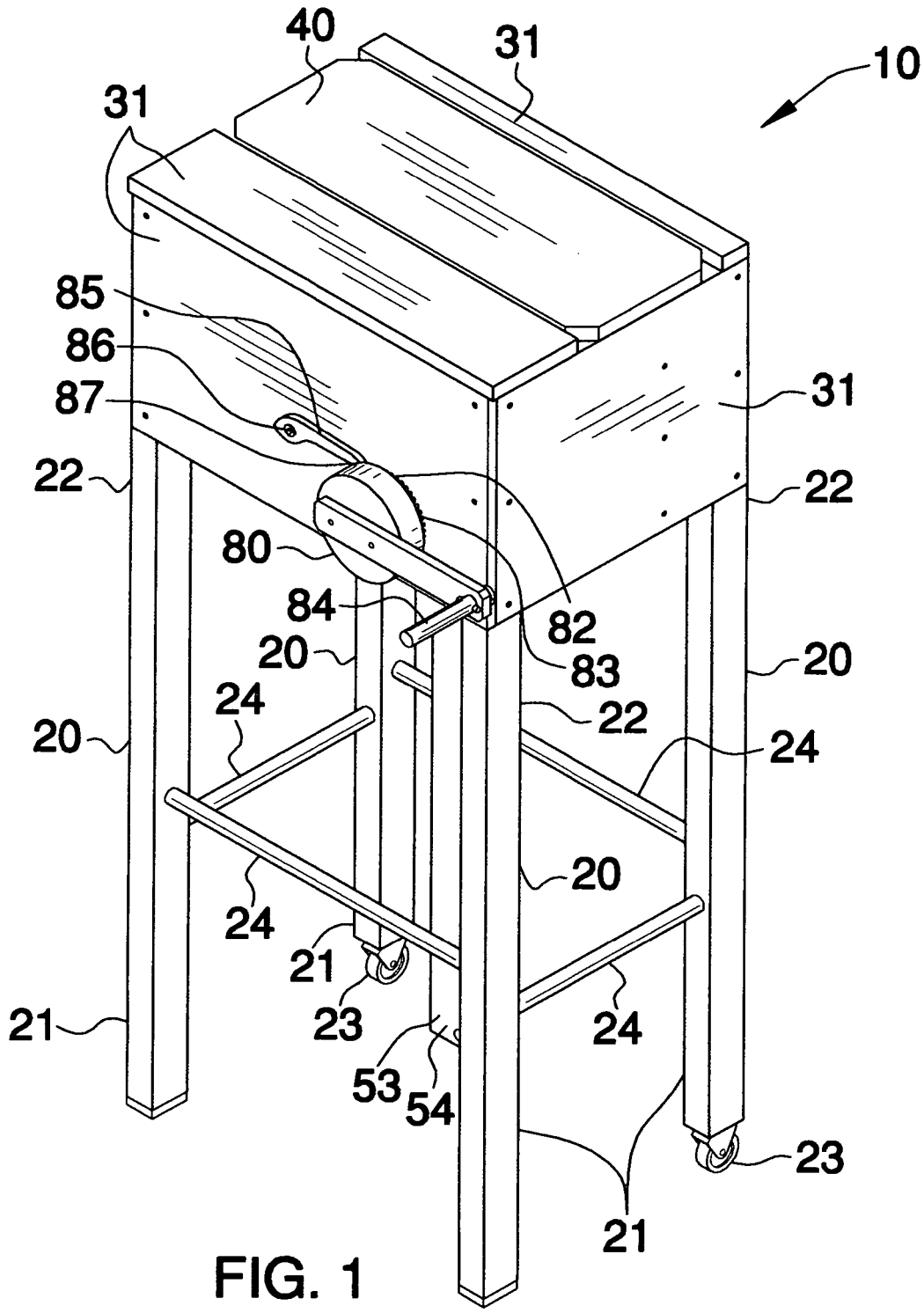
FIG. 1 is a perspective view showing a device for lifting cabinets, in accordance with the present invention.
Figure 2:
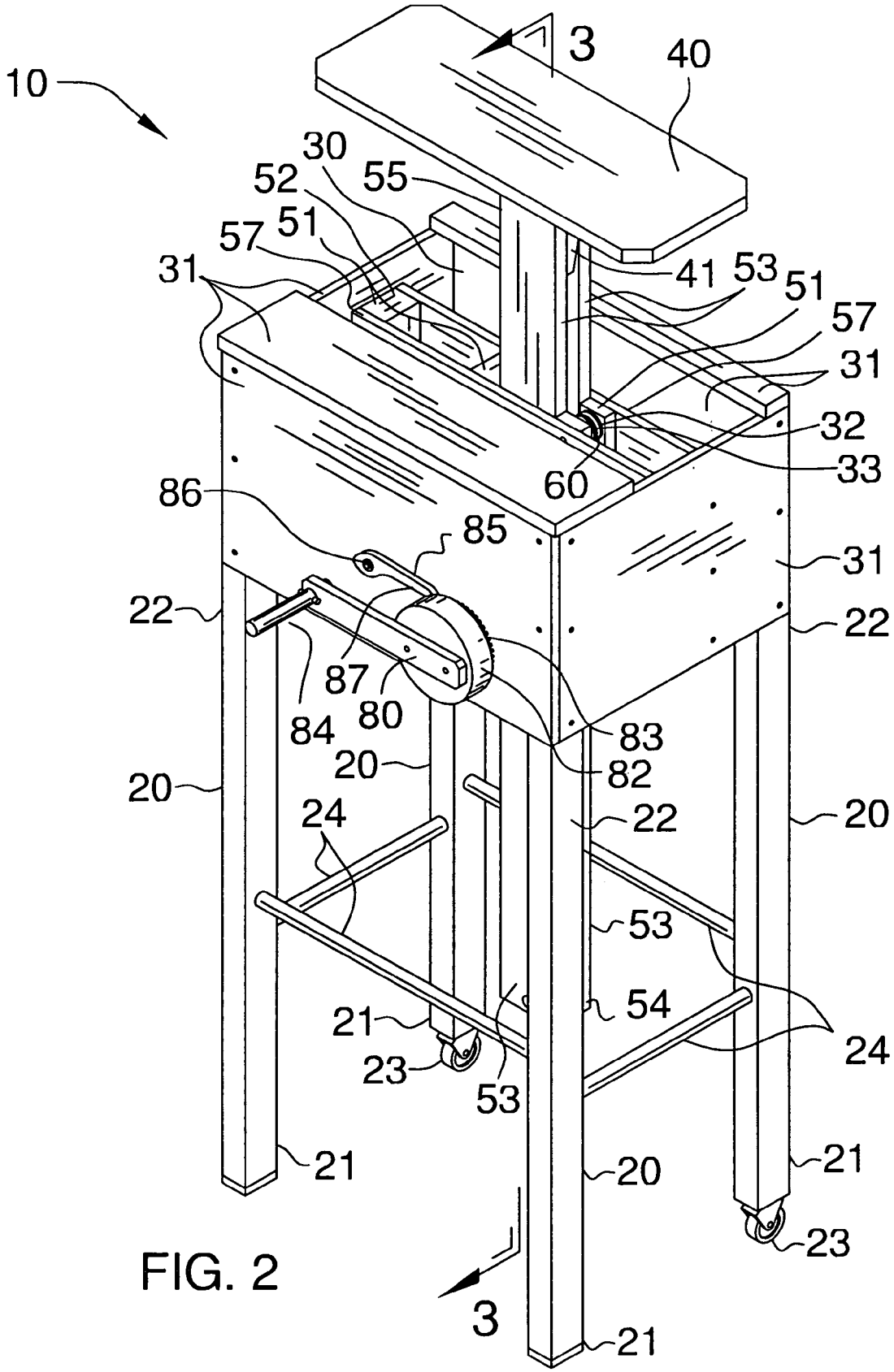
FIG. 2 is a perspective view of the device shown in FIG. 1, with the movable section vertically raised to an extended position.
Figure 3:
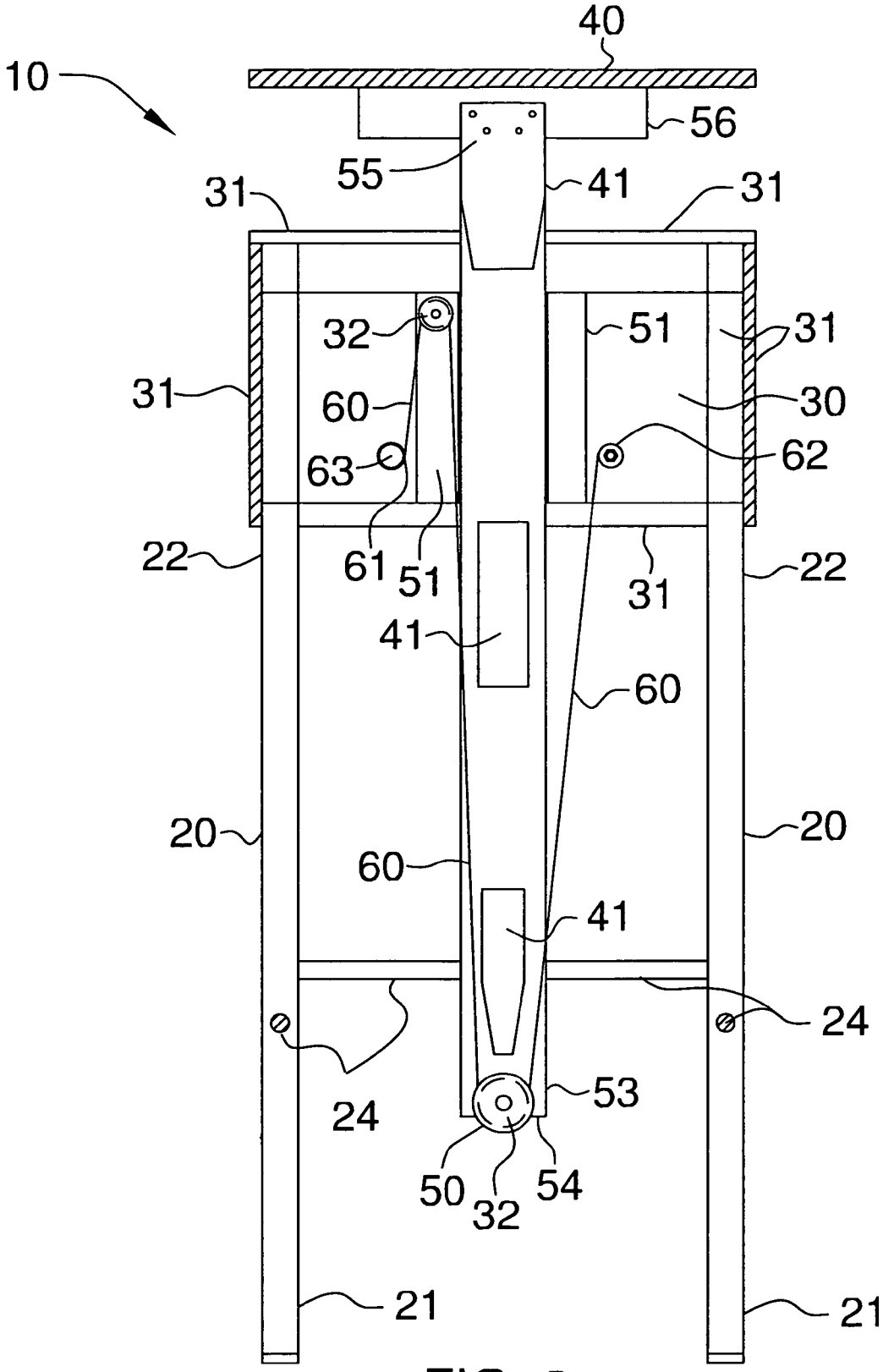
FIG. 3 is a cross-sectional view of the device shown in FIG. 2 taken along line 3—3.
Figure 4:
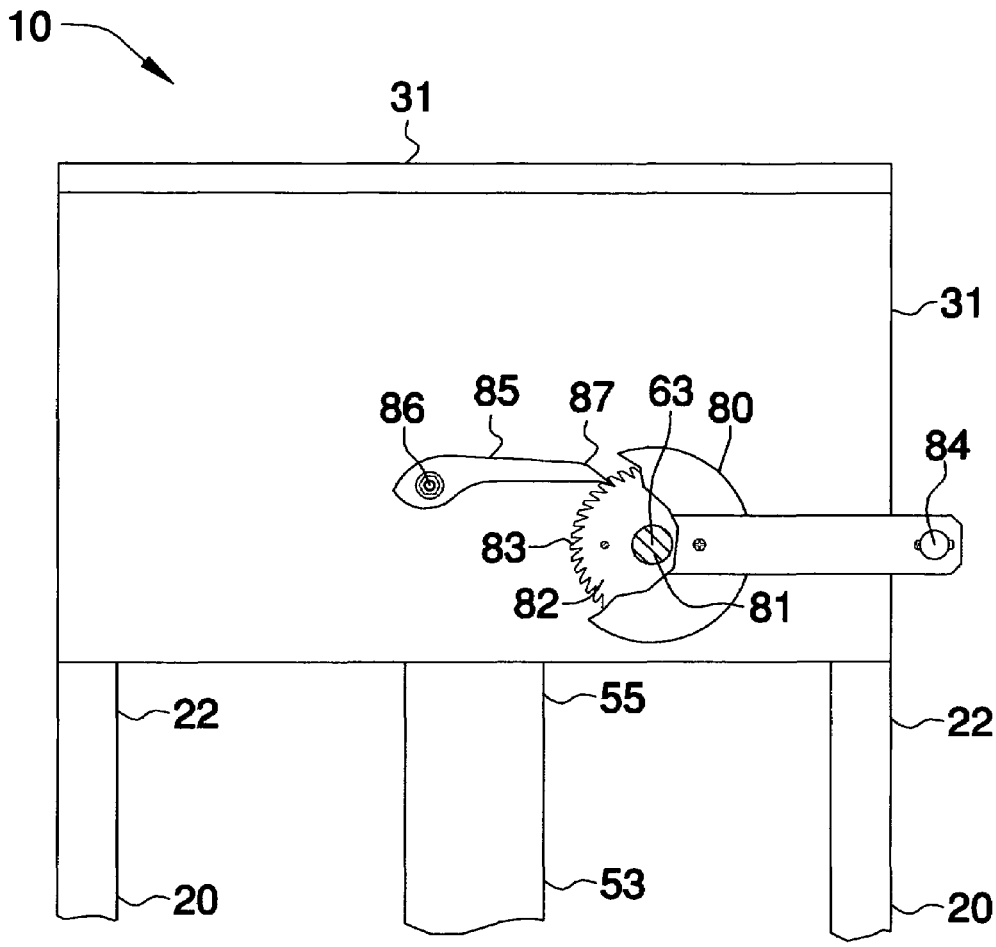
FIG. 4 is an enlarged side elevational view of the device shown in FIG. 1 with the pawl engaged with the gear.
Figure 6:
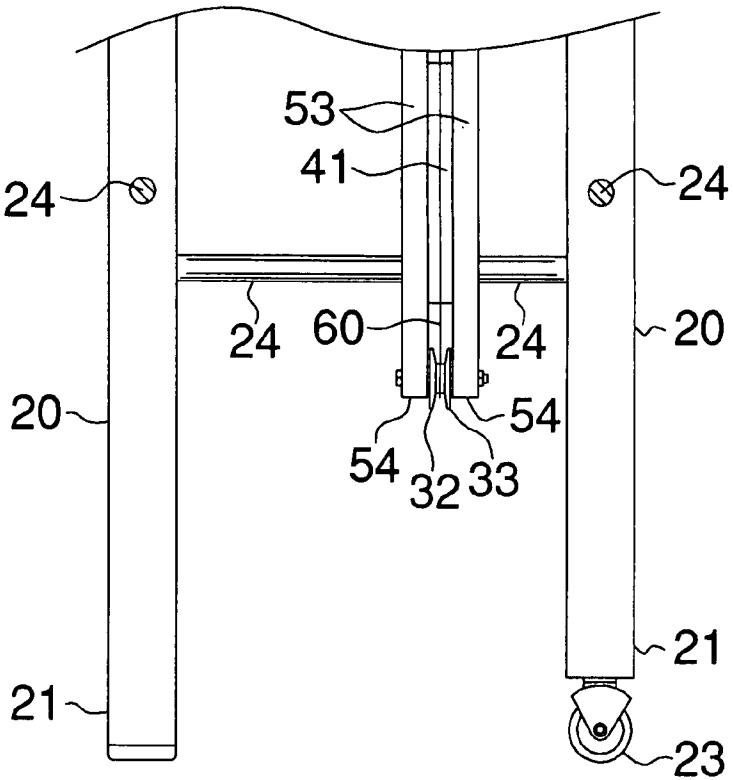
FIG. 6 is an enlarged partial cross-sectional view of the device shown in FIG. 1.
Figure 5:
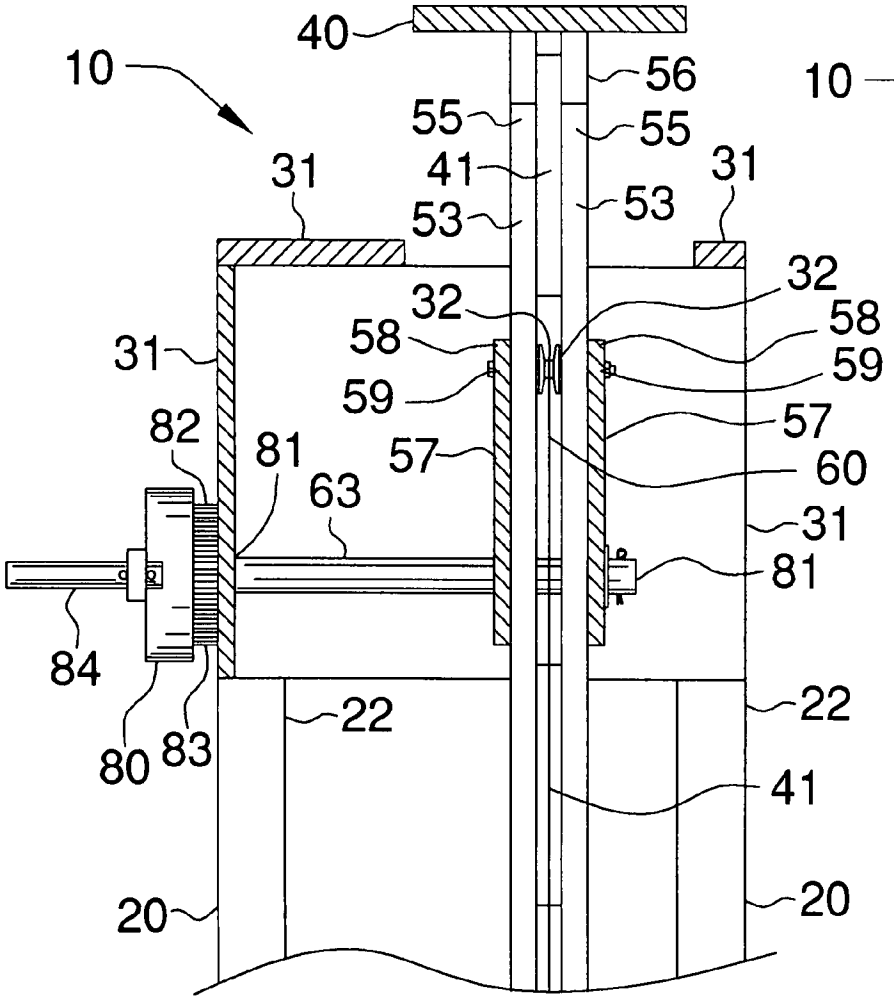
FIG. 5 is an enlarged partial cross-sectional view of the pulley mechanism shown in FIG. 3.

The present invention will now be described more fully hereinafter with reference to the accompanying drawings, in which a preferred embodiment of the invention is shown. This invention may, however, be embodied in many different forms and should not be construed as limited to the embodiment set forth herein. Rather, this embodiment is provided so that this application will be thorough and complete, and will fully convey the true scope of the invention to those skilled in the art. Like numbers refer to like elements throughout the figures.

The device of this invention is referred to generally in FIGS. 1–6 by the reference numeral 10 and is intended to provide a cabinet lifting and supporting device. It should be understood that the device 10 may be used to lift many different types of cabinets and other heavy hardware that are normally installed at an elevated position.

Referring initially to FIG. 1, the device 10 includes a plurality of elongated support legs 20 having lower end portions 21 and respective upper end portions 22 disposed substantially vertically thereabove. The device 10 further includes a plurality of castor wheels 23 attached to select ones of the plurality of support legs 20 for advantageously allowing the device 10 to be readily transported between remote locations.

The device 10 further includes a plurality of elongated dowels 24 connected to the plurality of support legs 20 and extending substantially transversely therebetween respectively. The plurality of dowels 24 advantageously prevents movement of the plurality of support legs 20 and maintains the device 10 at a substantially stable positioned during operating conditions. The present invention further includes a plurality of side panels 31 secured to the upper end portions 22 of the plurality of support legs 20 for defining a cavity 30 therebetween.

The device 10 further includes a moveable section 40 that has a longitudinal axis and is disposed substantially medially of the plurality of side panels 31. A pulley mechanism 50 selectively lifts the movable section 40 in a substantially vertical direction between raised and lowered positions. The movable section 40 includes a plurality of spacers 41 connected between the plurality of first support members 53 for assisting to maintain same at substantially stable positions. The pulley mechanism 50 is partially disposed within the cavity 30 and is anchored to the moveable section 40 and the plurality of side panels 31.

Such a pulley mechanism 50 includes a plurality of spaced cross-braces 51 extending substantially parallel to the axis and that has opposed end portions 52 connected to select ones of the plurality of side panels 31. The pulley mechanism 50 further has a plurality of elongated first support members 53, that are oriented in a substantially vertical position, and that has lower 54 and upper 55 end portions respectively.

A support bracket 56 is connected to the upper end portions 55 of the plurality of first support members 53 and to the movable platform 40 respectively. The present invention further includes a plurality of second support members 57 connected medially of the plurality of cross-braces 51 and adjacent the plurality of first support members 53. Such a plurality of second support members 57 define a path through which the plurality of first support members 53 are movable.

An elongated flexible rope 60 has opposed end portions 61, 62 secured to the shaft 63 and one side panel 31 respectively and a plurality of sheaves 32 are connected to the plurality of first 53 and second support members 57 respectively. The plurality of second support members 57 includes an upper end portion 58 that has a notch 59 formed therein respectively for advantageously supporting one of the plurality of sheaves 32 therein. The plurality of sheaves 32 have a grooved rim 33 for receiving the rope 60 therealong and for advantageously changing a direction and a point of application of a pulling force and in a predetermined combination to increase the applied force for lifting a cabinet positioned onto the movable platform 40.

The present invention also includes a cranking mechanism 80 for operably winding the rope 60 in a predetermined direction. Such a cranking mechanism 80 includes an elongated shaft 63 that has opposed end portions 81 secured to the plurality of second support members 57 and extending outwardly from one the plurality of side panels 31 respectively. A gear 82 that has a serrated outer surface 83 is connected to the shaft 63 and a crank handle 84 is connected to the shaft 63 for causing the gear 82 to rotate in a predetermined direction as the handle 84 is radially moved about the shaft 63.

The cranking mechanism 80 further includes a pawl 85 that has a first end portion 86 pivotally connected to the one side panel 31 and further has a second end portion 87 selectively engageable with the gear 82 for advantageously permitting the gear 82 and the shaft 63 to rotate in only one direction, thereby preventing the platform 40 from unexpectedly moving downwardly after a cabinet is placed thereon.

The appealing features of the device 10 are its ease of use, convenience, accuracy, safety, and efficiency. This device 10 substantially reduces the amount of effort required to raise and install a wall-mounted cabinet in a kitchen or related area. It also enables a single worker to perform this task without any undue effort. Its ability to precisely hold a cabinet in position further increases the accuracy of the cabinet's placement.

While the invention has been described with respect to a certain specific embodiment, it will be appreciated that many modifications and changes may be made by those skilled in the art without departing from the spirit of the invention. It is intended, therefore, by the appended claims to cover all such modifications and changes as fall within the true spirit and scope of the invention.

In particular, with respect to the above description, it is to be realized that the optimum dimensional relationships for the parts of the present invention may include variations in size, materials, shape, form, function and manner of operation. The assembly and use of the present invention are deemed readily apparent and obvious to one skilled in the art.

What is claimed as new and what is desired to secure by Letters Patent of the United States is:

1. A device for lifting and supporting a cabinet during installation thereof, said device comprising:

a plurality of elongated support legs having lower end portions and respective upper end portions disposed substantially vertically thereabove;

a plurality of elongated dowels directly connected to said plurality of support legs and extending substantially transversely therebetween respectively, said plurality of dowels preventing movement of said plurality of support legs and for maintaining said device at a substantially stable position during operating conditions;

a plurality of side panels directly secured to said upper end portions of said plurality of support legs and for defining a cavity therebetween, each of said side panels having opposed end portions directly conjoined to an adjacent one of said side panels such that said side panels extending along an entire distance between said support legs;

a moveable section having a longitudinal axis and being disposed medially of said plurality of side panels;

pulley means for selectively lifting said movable section in a substantially vertical direction between raised and lowered positions, said pulley means being partially disposed within said cavity and being anchored to said moveable section and said plurality of side panels;

wherein said pulley means comprises:

a plurality of spaced cross-braces extending substantially parallel to the axis and having opposed end portions directly connected to select ones of said plurality of side panels;

a plurality of elongated first support members having lower end portions and upper end portions respectively, said plurality of support members being oriented in a substantially vertical position;

a support bracket directly connected to said upper end portions of said plurality of first support members and to said movable platform respectively;

a plurality of second support members directly connected medially of said plurality of cross-braces and adjacent said plurality of first support members, said plurality of second support members defining a path through which said plurality of first support members are movable;

an elongated flexible rope and a plurality of sheaves directly connected to said plurality of first and second support members respectively, each of said plurality of sheaves having a grooved rim for receiving said rope therealong for changing a direction and a point of application of a pulling force and in a predetermined combination to increase the applied force for lifting a cabinet positioned onto said movable platform; and cranking means for operably winding said rope in a predetermined direction.

2. The device of claim 1, wherein said cranking means comprises:

an elongated shaft having opposed end portions directly secured to said plurality of second support members and extending outwardly from one said plurality of side panels respectively;

a gear having a serrated outer surface and being connected to said shaft;

a crank handle directly connected to said shaft and for causing said gear to rotate in a predetermined directions as said handle is radially moved about said shaft; and a pawl having a first end portion pivotally and directly connected said one side panel and further having a second end portion selectively engageable with said gear for permitting said gear and said shaft to rotate in only one direction and thereby preventing said platform from unexpectedly moving downwardly after a cabinet is placed thereon.

3. The device of claim 2, wherein said rope has opposed end portions directly secured to said shaft and said one side panel respectively.

4. The device of claim 2, wherein said plurality of second support members include an upper end portion having a notch formed therein respectively and for supporting one of said plurality of sheaves.

5. The device of claim 1, further comprising:

a plurality of castor wheels directly attached to selected ones of said plurality of support legs for allowing said device to be readily transported between remote locations.

* * * * *